US008025464B2

(12) United States Patent
Fonfrede et al.

(10) Patent No.: US 8,025,464 B2
(45) Date of Patent: Sep. 27, 2011

(54) SEVERING DEVICE WITH CONTROLLED TRIGGERING

(75) Inventors: Dominique Fonfrede, Villard d'Hery (FR); Jean-Baptiste Fonfrede, Mercury (FR)

(73) Assignee: Recepieux, La Chavanne (FR)

( * ) Notice: Subject to any disclaimer, the term of this patent is extended or adjusted under 35 U.S.C. 154(b) by 240 days.

(21) Appl. No.: 12/449,195

(22) PCT Filed: Jan. 29, 2008

(86) PCT No.: PCT/FR2008/000100

§ 371 (c)(1),
(2), (4) Date: Jul. 28, 2009

(87) PCT Pub. No.: WO2008/110682

PCT Pub. Date: Sep. 18, 2008

(65) Prior Publication Data

US 2010/0067990 A1 Mar. 18, 2010

(30) Foreign Application Priority Data

Feb. 23, 2007 (FR) ..... 07 01314

(51) Int. Cl.
*E02D 9/00* (2006.01)

(52) U.S. Cl. ..... 405/234; 102/326; 102/325

(58) Field of Classification Search ..... 405/229, 405/230, 231, 232, 233, 234; 102/301, 325, 102/326, 328

See application file for complete search history.

(56) References Cited

U.S. PATENT DOCUMENTS

| | | | | |
|---|---|---|---|---|
| 3,432,977 | A * | 3/1969 | Scholl | 405/234 |
| 3,960,082 | A | 6/1976 | Sloevsky et al. | |
| 4,571,124 | A | 2/1986 | Matsui et al. | |
| 6,623,212 | B1 | 9/2003 | Fonfrede et al. | |

FOREIGN PATENT DOCUMENTS

| | | |
|---|---|---|
| DE | 1 043 155 | 11/1958 |
| EP | 0 162 276 A2 | 11/1985 |
| JP | A 60-99355 | 6/1985 |
| JP | A 8-285500 | 11/1996 |
| WO | WO 00/36228 A1 | 6/2000 |

* cited by examiner

*Primary Examiner* — Frederic L Lagman
(74) *Attorney, Agent, or Firm* — Oliff & Berridge, PLC

(57) ABSTRACT

Device for severing parts of a concrete work, comprising a container in which an over-pressure is generated by a gas produced by a chemical reaction between a chemical compound and an aqueous solution after a predetermined delay. The container includes the aqueous solution and is attached to a case comprising a first recess for storing the chemical compound. A burst disk is arranged between the first recess and the container for ensuring a total sealing between the chemical compound and the aqueous solution. The case includes a second recess enclosing an electronic trigger, an actuator being controlled by the trigger to cause bursting of the burst disk after a predetermined delay, causing said chemical reaction inside the container.

10 Claims, 6 Drawing Sheets

SEVERING DEVICE WITH CONTROLLED TRIGGERING

FIELD OF THE INVENTION

The invention relates to a device for severing parts of a concrete work, comprising a container in which an over-pressure is generated by a gas produced by a chemical reaction between a chemical compound and an aqueous solution after a predetermined delay, the container including the aqueous solution and being attached to a case comprising a first recess for storing the chemical compound, and a burst disk being arranged between the first recess and the container for ensuring a total sealing between the chemical compound and the aqueous solution.

STATE OF THE ART

There are severing devices comprising a container for enclosing a chemical or mechanical reactant that, by expanding, causes the concrete part to crack. Patent application WO-0036228 thus describes a severing element comprising a flask having a flat closed bottom wall and a sidewall forming an acute angle with the bottom wall. A rigid tube linked to a tubular fitting arranged at the top of the sidewall forms a channel for bringing a rupturing agent inside the flask. This type of severing element is awkward to use, because several steps are required: placing the elements individually, and then introducing the rupturing agent into each of the flasks through the rigid hollow tubes. These two steps are time consuming on construction sites and require particular care, especially while inserting the rupturing agent.

One of the major problems of severing methods is the control of the expansion of the reactive agents, which generates cracks in the concrete. Indeed, the expansion of the reactive agent should not occur before the concrete sets, nor when the concrete's resistance becomes too high, especially its resistance to extension. The known expansion agents are often blends comprising water and quicklime, and generally additives, these additives being adapted to the operative temperature conditions of the concrete and of the type of work being constructed.

The expansion caused by the chemical reaction between the water and the quicklime is not easy to control, even using retardants. Thus, U.S. Pat. No. 4,571,124 describes a demolition-facilitating substance containing 30% in weight of powder and 70% in weight of water, placed in hollow protective tubes, themselves placed in a confined space of the region to demolish of a concrete pile. The powder constituting the demolition-facilitating substance comprises a calcium alumina ferrite, ($(CaO)_4Al_2O_3Fe_2O_3$), free calcium oxide (CaO), magnesium oxide (MgO) and a retardant, such as boron. The expansion of the demolition-facilitating substance generates cracks in the concrete pile at a predetermined level. One of the major drawbacks of this product is the use of the retardant whose role is to make the expansion, thus the generation of cracks, coincide with the increase in resistance of the concrete pile. It is however necessary to adapt the composition of the demolition-facilitating substance to the temperature conditions of the concrete on each construction site, especially by varying the proportion of retardant as a function of the temperature. This adapting of the expansion agent to the temperature conditions is difficult to implement on the construction sites.

Document JP 08 285500 relates to a container in which an overpressure is generated by gas production following a chemical reaction between a chemical compound and an aqueous solution contained in two recesses separated from each other by a burst disk. The reaction occurs when the container is projected against an object to burst.

OBJECT OF THE INVENTION

An object of the invention is to provide a severing device ensuring a controlled and reliable triggering of the chemical reaction independently of the environmental constraints, usable for any concrete work, and easy to implement.

The device is characterized in that the case includes a second recess enclosing an electronic trigger, an actuator being controlled by the trigger to cause bursting of the burst disk after a predetermined delay, causing said chemical reaction inside the container.

The triggering of the actuator occurs at an accurate time determined by the delay of the electronic trigger. A delay of 3 to 4 days should elapse between the triggering of the device and the initiation of the chemical reaction.

According to a preferred embodiment the disk is part of a cap mounted on, and sealing, the case. The cap comprises a hole having an internal threading, mating with an external threading on a hub extending the container. The actuator of the electronic trigger comprises a pyrotechnical detonator operable by discharge of a capacitor to burst the disk. The detonator may be located on a printed circuit board of the trigger or directly on the burst disk.

The trigger further comprises a timer circuit including a clock with a quartz crystal time base and a microcontroller. The initiation of the delay of the trigger and of the charging of the capacitor is triggered by an arming circuit comprising a magnetic switch cooperating with two permanent magnets of opposed polarities, one of the magnets being stationary and the other being removable through a pin.

The container closed by the cap has a recess limited by two tapered walls forming an acute angle and having a common external outline. The radial force components caused by the reaction forces are the largest in the vicinity of the external outline, such that they cause a horizontal fracture of the concrete along a plane intersecting the external outline, thus determining the severance zone. The action of the vertical components causes a slight lifting movement of the concrete pile during the severance operation.

BRIEF DESCRIPTION OF THE DRAWINGS

Other advantages and features of the invention will become apparent from the following description of particular embodiments of the invention, provided as non limiting examples, shown in the annexed drawings, among which.

DESCRIPTION OF PREFERRED EMBODIMENTS

A device for severing parts of concrete works, especially in the shape of posts, bars or cast walls, comprises a container 10 in which a large quantity of gas is generated, producing an over-pressure inside the container 10. This over-pressure causes the container to burst, and generates reaction forces capable of cracking concrete. The severing elements are installed, either before casting the concrete, preferably with a positioning frame, or inserted in the fresh concrete after casting, preferably with a rod that is re-usable or left in place.

the gas causing the over-pressure is produced by the chemical reaction between a chemical compound and an aqueous solution. The chemical compound is preferably chosen among calcium, alkaline metals (lithium, potassium and sodium), alkaline metal carbonates, calcium carbide, and calcium carbonate.

As an example, with calcium, the generated gas is hydrogen according to the following reaction: $Ca+H_2O \rightarrow \frac{1}{2}H_2+Ca(OH)$.

A few grams of chemical compound, for example 4 grams of pure calcium, generate sufficient gas for the severing of concrete parts. Other compounds may of course be used without departing from the invention.

For the expansion effect to occur when the concrete starts to set, it is necessary to control the production of gas inside the container 10, so that it doesn't occur as soon as the concrete is cast, or after the concrete has become too hard. In order to achieve the reaction between the chemical compound and the aqueous solution at the right moment, the time when the aqueous solution contacts the chemical compound is controlled through the action of an electronic trigger 11. This trigger is housed in a case 12 provided with a cap 12A, which is screwed onto container 10 to seal it.

Figure 1:
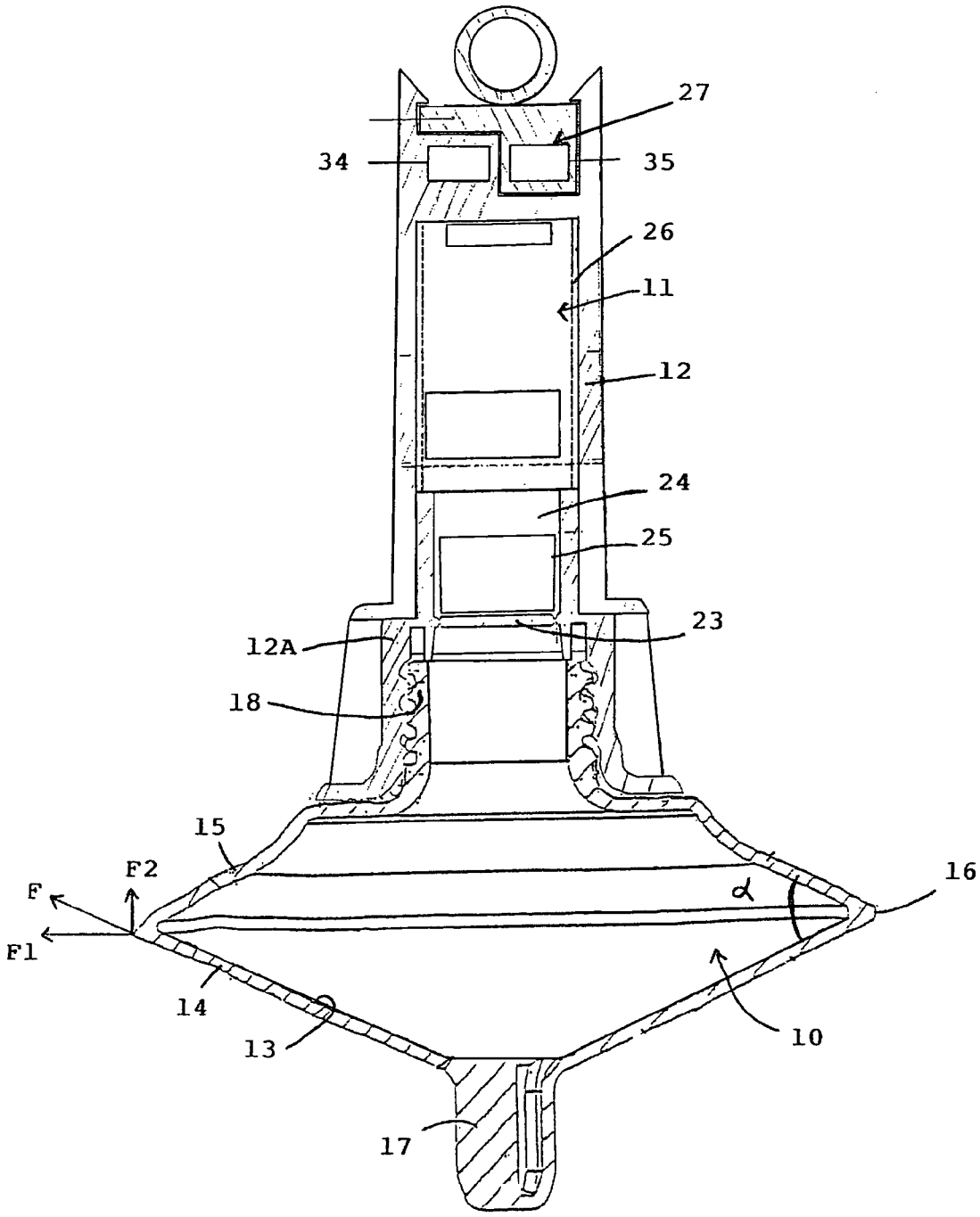
FIG. 1 is a vertical section view of the severing device of the invention, the container being assembled to the case containing the electronic trigger.
Figure 2:
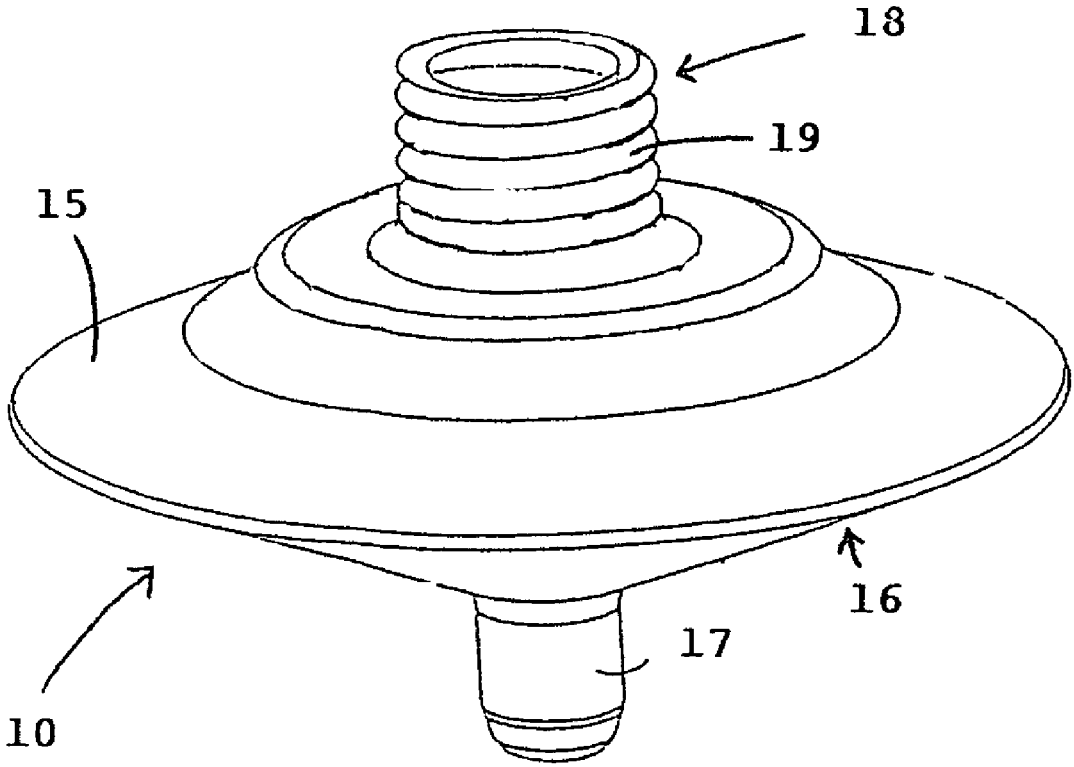
FIG. 2 shows a perspective view of the container.

According to a preferred embodiment, a container 10 of the type shown in FIGS. 1 and 2 is preferably used. Container 10, made of plastics, for example polyethylene, comprises an internal recess 13 limited by two tapered walls, a bottom wall 14 and a top wall 15, having a common external outline 16 and at an acute angle $\alpha$, comprised for example between 5° and 60°. The bottom wall 14 has a protruding mounting element 17, for mounting the container 10 to a metallic structure placed in the fresh concrete and keeping it in place. The upper wall 15 is extended by a hub 18 having an external threading 19 for screwing into a mating threading 21 of a hole 20 of cap 12A, for mounting and sealing the container 10 to the case 12 of electronic trigger 11.

The cap 12A is separated from the case 12 by a burst disk 23 having a predetermined thickness, and forming a separation wall for ensuring a total sealing between the calcium and the water as long as the triggering command has no been issued by the electronic trigger 11. Above the burst disk 23, the case 12 is divided into a first recess 24 enclosing the chemical compound cartridge 25, for instance calcium based, and a second recess 26 enclosing the electronic trigger 11.

Figure 3:
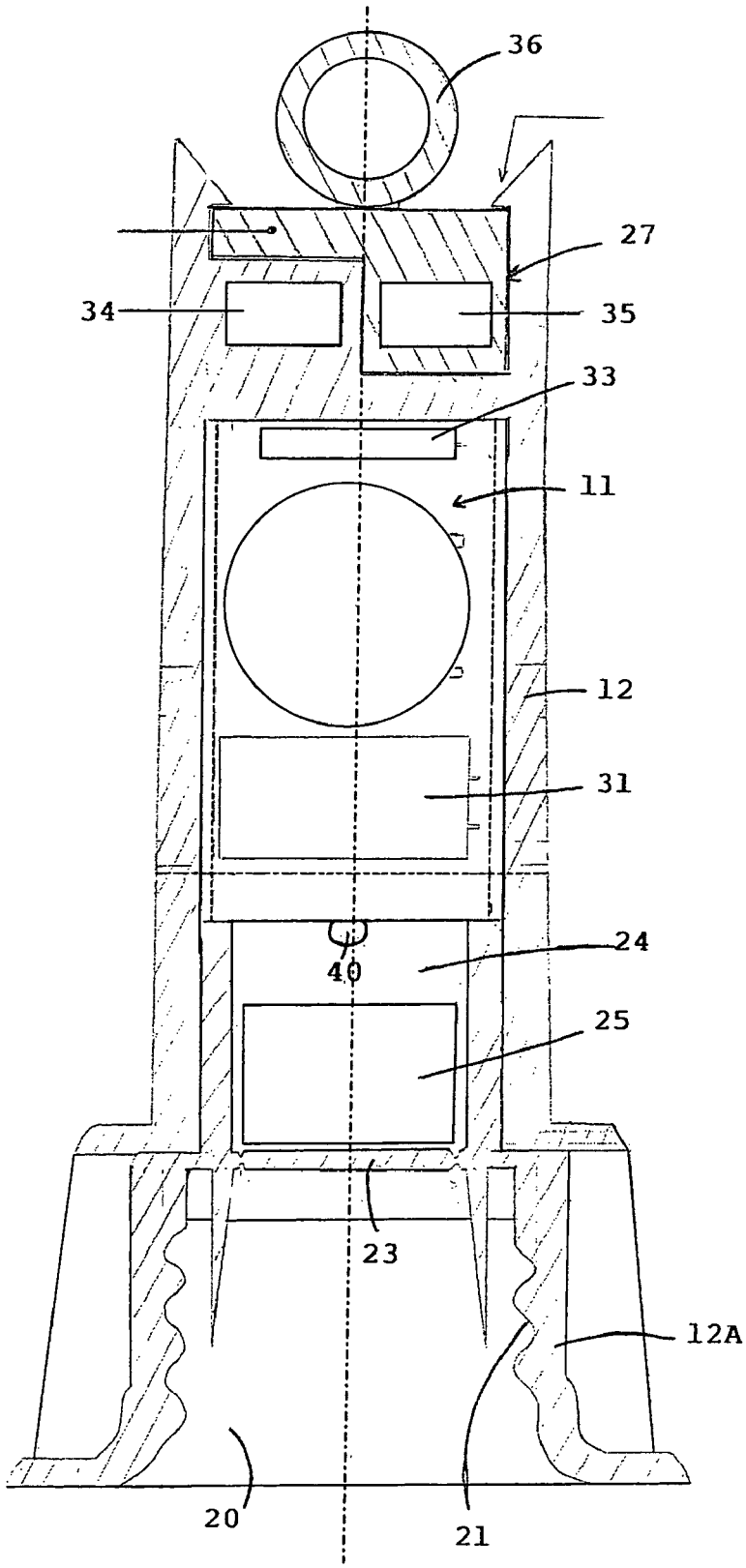
FIG. 3 is a view of the case of FIG. 1, after unscrewing and separating the bottom container.
Figure 4:
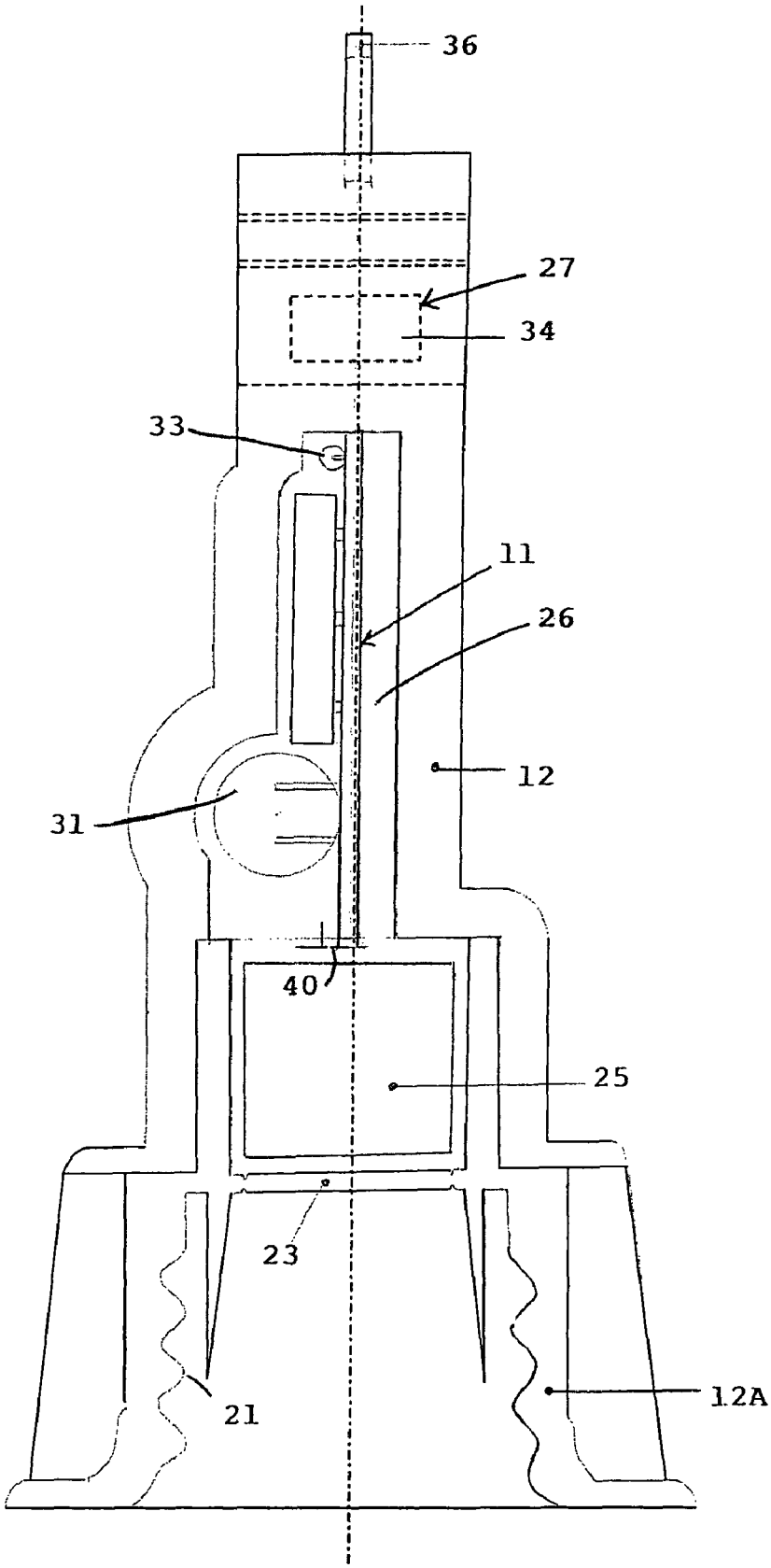
FIG. 4 shows a vertical section view of FIG. 3.
Figure 5:
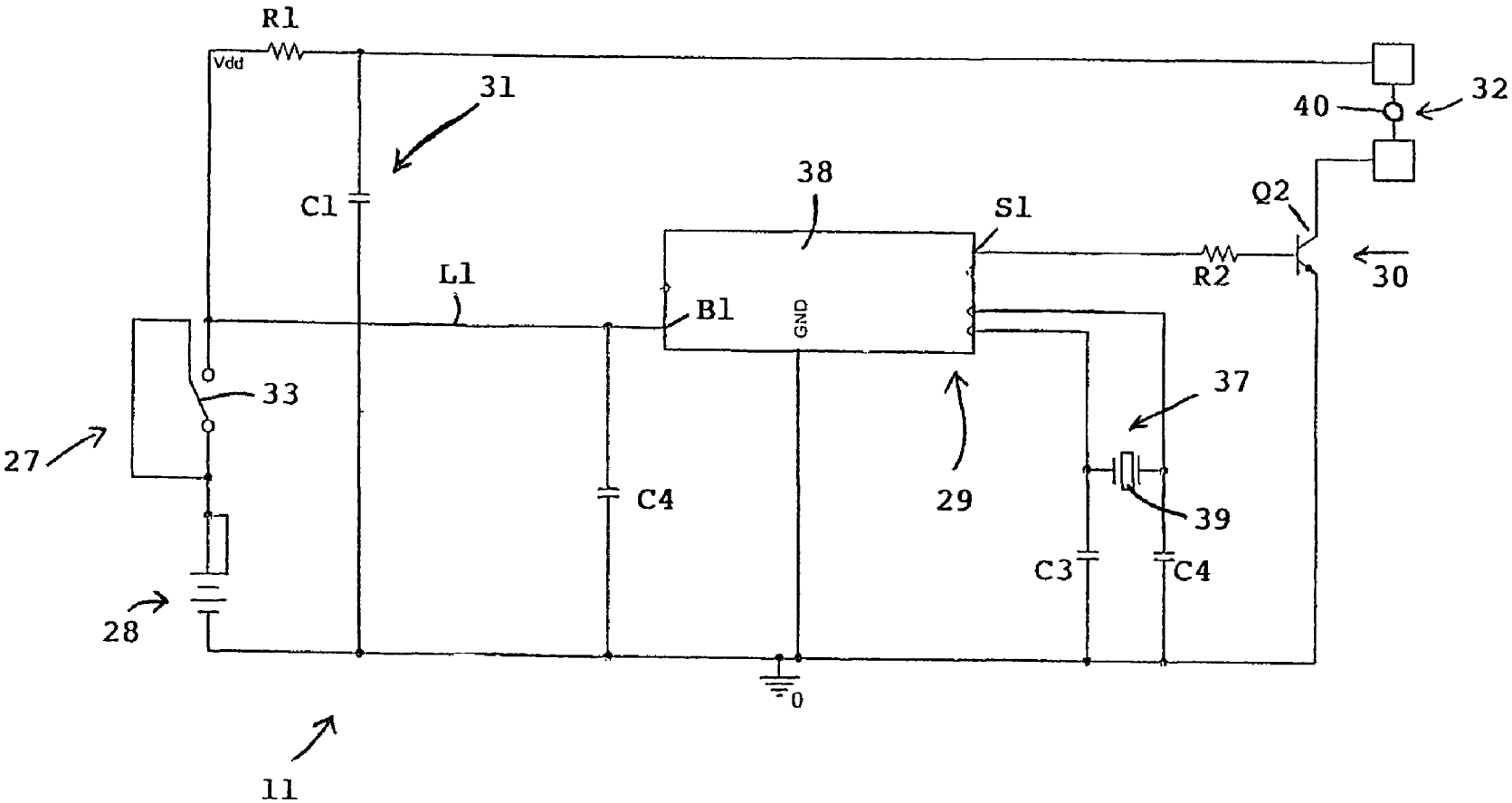
FIG. 5 illustrates a schematic diagram of the trigger.

In FIGS. 3 to 5, the elements of the electronic trigger 11 are interconnected on a printed circuit board housed vertically in the second recess 26. The trigger comprises an arming circuit 27, a DC power supply 28, for instance a 3V battery, a timer 29, a switching circuit 30, an energy reserve circuit 31, and an actuator 32.

The arming circuit 27 comprises, for example, a magnetic switch 33, such as a Reed relay with a flexible contact blade, cooperating with two permanent magnets 34, 35 placed next to each other at the top portion of case 12. One of the magnets 34 is stationary, and the other 35 can be freed by the action of a pin 36. The two magnets 34, 35 are identical but have opposed magnetic polarities. When the two magnets 34, 35 are present, their magnetic fields cancel and switch 33 is open. The arming consists in removing the second magnet 35 by pulling the pin 36, causing the closing of switch 33. Any other type of switch, such as electromechanic or electronic, can be used instead of magnetic switch 33.

The 3V battery of supply 28 is connected in series with switch 33 and a resistor R1. The energy reserve circuit 31 comprises an electrolytic capacitor C1 connected in parallel between resistor R1 and the low potential forming the ground of supply 28.

The timer 29 comprises a clock 37 and a microcontroller 38. The clock 37 comprises a quartz time base 39 connected both to microcontroller 38 and to ground through two decoupling capacitors C3, C4.

The switching circuit 30 comprises a power transistor Q2, for instance an NPN bipolar transistor, having its collector connected in series with the actuator 32, and its emitter to ground. The base of transistor Q2 is connected to an output S1 of microcontroller 38 through a resistor R2. Any other type of switching element may of course be used.

The actuator 32 comprises a pyrotechnical detonator 40 and the plastics burst disk 23 it is intended to destroy upon discharge of capacitor C1. The detonator 40 can be a Davey Bickford model N28BR, and it is arranged either on the circuit board, or directly on the burst disk 23. In the latter case, an electrical link (not shown) connects the circuit board to the detonator.

The electronic trigger 11 operates as follows:

The removal of pin 36 causes the actuation and closing of switch 33, starting the trigger timing cycle. The output of switch 33 is connected through an electric link L1 to the supply terminal B1 of microcontroller 38 in order to deliver a voltage adapted to the timer circuit 29. The battery of power supply 28 starts the timing and at the same time charges capacitor C1 of the energy reserve circuit 31. An additional capacitor C4 is connected between the supply terminal B1 and ground to continue to supply microcontroller 38 after transistor Q2 has switched. When the timer delay is reached, the output S1 of microcontroller 38 delivers a switch order to transistor Q2, which then switches from off to on. Capacitor C1 then discharges into detonator 40, which then explodes and causes an over-pressure in case 12. The burst disk 23 yields as soon as the pressure exceeds a predetermined threshold, for instance 5 bars.

When disk 23 thus bursts, the calcium 25 stored in the first recess 24 falls into container 10 and blends with the water, causing a chemical reaction that generates hydrogen gas inside the closed container. The inverse procedure can also be envisaged, where the water is above and runs onto the calcium.

In FIG. 1, the shape of container 10 concentrates the reaction forces F resulting from the expansion effect when the chemical compound is freed by the electronic trigger 11, and blends with the water contained in container 10. Pressure being and inverse function of the area, the radial components F1 generated by the reaction forces are greater in the vicinity of the external outline 16, common to both tapered walls 14 and 15. This results in a horizontal fracture of the concrete along a plane intersecting the external outline 16, which determines the severance zone 22. The action of the vertical force components F2 may cause a slight lifting movement of the concrete pile upon severance.

Temperature variation influences the expansion effect very little and it is not necessary to change the quantity or composition of the chemical compound and/or of the aqueous solution as a function of the temperature.

The container 10 used for the severance may also be of another shape than that described here. For example, the container type described in patent application WO-0036228 may also be used for the invention.

Figure 6:
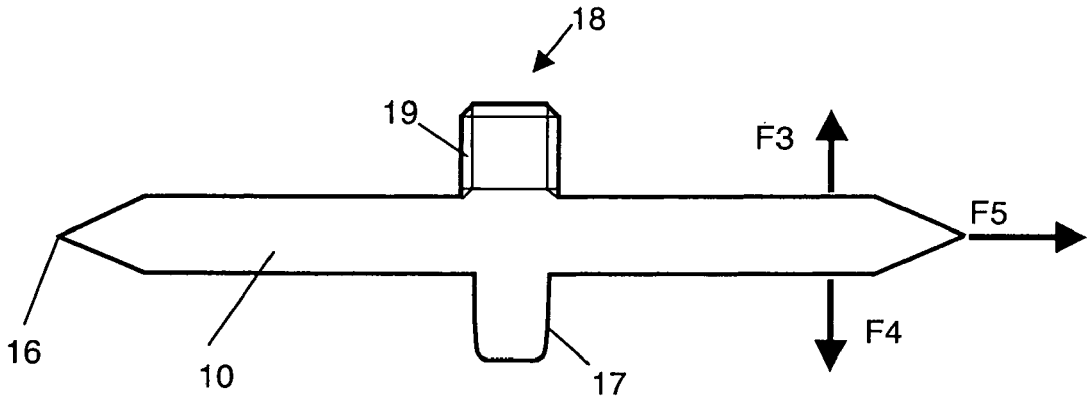
FIG. 6 is an alternative of the container of FIG. 2.

It is also possible to use the container 10 shown in FIG. 6, having a shallower profile that that of FIG. 2. The lower and upper walls are parallel and subject respectively to compression pressure (arrow F4) and extension pressure (arrow F3). The direction of the crack after expansion extends horizontally (arrow F5), and intersects the outline 16 like in FIG. 1.

The invention claimed is:

1. Device for severing parts of a concrete work, comprising a container in which an over-pressure is generated by a gas produced by a chemical reaction between a chemical compound and an aqueous solution after a predetermined delay, the container including the aqueous solution and being attached to a case comprising a first recess for storing the chemical compound, and a burst disk being arranged between the first recess and the container for ensuring a total sealing between the chemical compound and the aqueous solution wherein the case includes a second recess enclosing an electronic trigger, an actuator being controlled by the trigger to cause bursting of the burst disk after a predetermined delay, causing said chemical reaction inside the container.

2. Device for severing according to claim 1, wherein the disk is part of a cap mounted on, and sealing, the case.

3. Device for severing according to claim 2, wherein the cap comprises a hole having an internal threading, mating with an external threading on a hub extending the container.

4. Device for severing according to claim 1, wherein the actuator of the electronic trigger comprises a pyrotechnical detonator operable by discharge of a capacitor to burst the disk.

5. Device for severing according to claim 4, wherein the trigger further comprises a timer circuit operable to control a switching circuit connected in series with the actuator.

6. Device for severing according to claim 5, wherein the timer circuit comprises a clock having a quartz crystal time base and a microcontroller.

7. Device for severing according to claim 4, wherein the initiation of the delay of the trigger and of the charging of the capacitor is triggered by an arming circuit comprising a magnetic switch cooperating with two permanent magnets of opposed polarities, one of the magnets being stationary and the other being removable through a pin.

8. Device for severing according to claim 6, wherein the switching circuit comprises a bipolar transistor having a base connected to an output of the microcontroller through a resistor.

9. Device for severing according to claim 4, wherein the detonator is located on a printed circuit board of the trigger or directly on the burst disk.

10. Device for severing according to claim 1, wherein the container closed by the cap has a recess limited by two tapered walls forming an acute angle and having a common external outline.

* * * * *